US005331121A

United States Patent [19]

Tsuji

[11] Patent Number: 5,331,121

[45] Date of Patent: Jul. 19, 1994

[54] ELEVATOR CONTROL APPARATUS

[75] Inventor: Shintaro Tsuji, Inazawa, Japan

[73] Assignee: Mitsubishi Denki Kabushiki Kaisha, Tokyo, Japan

[21] Appl. No.: 983,618

[22] Filed: Nov. 30, 1992

Related U.S. Application Data

[63] Continuation of Ser. No. 658,510, Feb. 21, 1991 abandoned.

[30] Foreign Application Priority Data

Mar. 28, 1990 [JP] Japan ..... 2-77114

[51] Int. Cl.[5] ..... G66B 1/20

[52] U.S. Cl. ..... 187/124; 187/127; 187/131

[58] Field of Search ..... 187/124, 127, 133, 131; 395/11, 61; 365/49

[56] References Cited

U.S. PATENT DOCUMENTS

| | | | |
|---|---|---|---|
| 4,760,896 | 8/1988 | Yamaguchi | 187/124 |
| 4,860,207 | 8/1989 | Kubo | 364/424.01 |
| 4,947,965 | 8/1990 | Kuzunuki et al. | 187/127 |
| 4,989,695 | 2/1991 | Kubo | 187/101 |
| 4,990,838 | 2/1991 | Kawato et al. | 318/568.10 |
| 5,022,498 | 6/1991 | Sasaki et al. | 187/127 |
| 5,040,215 | 8/1991 | Amano et al. | 381/43 |
| 5,046,019 | 9/1991 | Basehore | 365/49 |
| 5,083,640 | 1/1992 | Tsuji | 187/127 |
| 5,168,135 | 12/1992 | Kubo et al. | 187/127 |

FOREIGN PATENT DOCUMENTS

| | | | |
|---|---|---|---|
| 54-35371 | 2/1979 | Japan | B66B 1/18 |
| 54-35372 | 2/1979 | Japan | B66B 1/18 |
| 54-24578 | 8/1979 | Japan | B66B 3/00 |
| 54-35368 | 11/1979 | Japan | B66B 1/18 |
| 56-135969 | 10/1981 | Japan | B66B 3/00 |
| 59-124671 | 7/1984 | Japan | B66B 1/18 |
| 59-177266 | 10/1984 | Japan | B66B 1/18 |
| 59-182182 | 10/1984 | Japan | B66B 3/00 |
| 59-4583 | 12/1984 | Japan | B66B 1/18 |
| 61-4748 | 2/1986 | Japan | B66B 1/18 |
| 62-43975 | 11/1987 | Japan | B66B 1/18 |
| 331173 | 8/1991 | Japan | B66B 1/18 |
| 2195791 | 4/1988 | United Kingdom | 187/127 |
| 2237663 | 5/1991 | United Kingdom | 187/127 |
| 2245997 | 1/1992 | United Kingdom | 187/127 |

OTHER PUBLICATIONS

"Collective Computation in Neuronlike Circuits"; Scientific American; vol. 257, pp. 104–108; Dec. 1987.

"Chips for the Nineties and Beyond"; BYTE; pp. 342–346; Nov. 1990.

"Design of a Neural-Based A/D Converter Using Modified Hopfield Network"; IEEE Journal of Solid-State Circuits, vol. 24, No. 4, pp. 1129–1135; Aug. 1989.

*Primary Examiner*—Thomas M. Dougherty

*Attorney, Agent, or Firm*—Leydig, Voit & Mayer

[57] ABSTRACT

An elevator control apparatus determines an estimation of a car's crowdedness based on the a car's crowdedness when the car stops or passes an elevator hall, and controls an operation of the car using the obtained estimated car crowdedness. The elevator control apparatus includes an input data conversion unit for converting traffic data, including a position of the car, a direction of a movement, a car load and calls to be responded, into a form in which it can be used as input data of a neural net, an estimated car crowdedness operation unit including an input layer for taking in the input data, an output layer for outputting the estimated car crowdedness, and an intermediate layer provided between said input and output layers and in which a weighting factor is set, the estimated car crowdedness operation unit constituting the neural net, and an output data conversion unit for converting the estimated car crowdedness output from the output layer into a form in which it can be used for a predetermined control operation.

20 Claims, 10 Drawing Sheets

FIG. 8 B

| | | |
|---|---|---|
| WHEN CAR NO.2 IS NOT VIRTUALLY ALLOCATED | INPUT DATA : xa1 (1)~xa1 (N1)<br>OUTPUT DATA : ya3 (1)~ya3 (N3)、Tb2 (1)~Tb2 (N3) | STEP 37 |
| EVALUATED VALUE | W1、W2 | STEP 38 |
| WEIGHTING FACTOR | wa1 (i,j)、wa2 (j,k)<br>i=1,2,・・・,N1<br>j=1,2,・・・,N2<br>k=1,2,・・・,N3 | RENEWED IN STEP 78 |
| | SURVEYED DATA<br>CREATION PERMIT DATA | STEP 40 |
| LEARNING DATA 1 | INPUT DATA : xa1 (1)~xa1 (N1)<br>OUTPUT DATA : ya3 (1)~ya3 (N3) | STEP 62 |
| | ACTUAL CROWDEDNESS: TA(1)~TA(N3) | STEP 67 |
| LEARNING DATA 2 | INPUT DATA : xa1 (1)~xa1 (N1)<br>OUTPUT DATA : ya3 (1)~ya3 (N3)<br>ACTUAL CROWDEDNESS: TA(1)~TA(N3) | |
| ⋮ | ⋮ | |
| LEARNING DATA S | INPUT DATA : xa1 (1)~xa1 (N1)<br>OUTPUT DATA : ya3 (1)~ya3 (N3)<br>ACTUAL CROWDEDNESS: TA(1)~TA(N3) | |
| WEIGHTING FACTOR IN LEARNIG | wa1 (i,j)、wa2 (j,k)<br>i=1,2,・・・,N1<br>j=1,2,・・・,N2<br>k=1,2,・・・,N3 | STEP 41, 71~78 |
| NUMBER OF LEARNING DATA SETS | m | STEP 40 |
| | WORKING AREA :<br>TEACHER DATA da (1)~da (N3)<br>n ETC. | |

ELEVATOR CONTROL APPARATUS

This application is a continuation of application Ser. No. 658,510, filed Feb. 21, 1991, now abandoned.

BACKGROUND OF THE INVENTION

1. Field of the Invention

This invention relates to an elevator control apparatus which is capable of estimating with a high degree of accuracy how crowded an elevator car becomes upon reaching each floor of a building.

2. Description of the Related Art

In conventional elevator apparatus with a plurality of elevator cars incorporated therein, group control operation is generally conducted. Examples of such group control operation include the allocation method. The allocation method is designed to improve the operation efficiency of, and shorten the waiting time for a car by an evaluated value for each car immediately after a hall call is registered, by selecting the car which has the best evaluated value as the car to be allocated, and by making only that car respond to the hall call.

However, at the time of the day when the traffic is heavy in a building, such as the beginning of working hours, lunch time or quitting time, the car to be allocated to the hall call may have been packed to its full capacity before it responds to the hall call. In that case, the car passes the hall call, and the allocation (forecasting) is determining to another car. Furthermore, even when the car reaches the hall, since the car is already crowded, all of the people who wait for the car may not be able to get on the car Such passage of the car or leaving of the passengers is not desirable because it prolongs the waiting time of the passengers who wait for the car.

To prevent occurrence of such phenomena, Japanese Patent Publication No. 47787/1987 discloses an elevator group-control apparatus which is designed to select as a car to be allocated a car which has the minimum general evaluated value when a hall call is registered. In that case, the general evaluated value is the sum of a waiting time evaluated value and a full packing evaluated value. The waiting time evaluated value is the sum of the squares of all the estimated waiting times obtained when each car is virtually allocated to the hall call. The full packing evaluated value is obtained by weighting the sum of the full packing probabilities (an index indicating the possibility that the car is packed to its full capacity) relative to all the hall calls which are obtained when each car is virtually allocated to the hall call.

Other techniques which are proposed to prevent occurrence of undesirable phenomena include an allocation method disclosed in Japanese Patent Laid-Open No. 177266/1984. This method uses as the above-described evaluated value an estimated value of a car load (or the number of passengers in the car). In another allocation method (proposed in Japanese Patent Publication No. 4748/1986, the car whose estimated value of the number of passengers exceeds a limited value is not allocated to the hall call.

When allocation of the car for a hall call is made on the basis of the estimated value of a car's crowdedness which will occur in the near future (hereinafter referred to as "an estimated car crowdedness"), the waiting time for the hall call can be shortened, and occurrence of undesirable phenomena, such as passage of the car due to full packing and leaving passengers behind, can be reduced.

However, if the estimated car crowdedness is inaccurate, the evaluated value no longer works as a reference value for the selection of the car to be allocated, making shortening of the waiting time for the hall call and prevention of undesirable phenomena impossible. Hence, accuracy of the estimated car crowdedness greatly affects the performance of the group control.

The above-described group-control apparatus which employ the estimated car crowdedness are designed to prevent passage of cars because of full packing. However, various other types of group control apparatus have also been proposed. For example, Japanese Utility Model Publication No. 43975/1987 discloses a method in which a hall call is not deleted to omit the task of re-operating registration of the hall call in a case where it is estimated, using the number of passengers who are waiting for the car, detected by a waiting passenger detector, and an estimated car load obtained by estimating the number of passengers who may get off the car at the floor to which the car call is made, that passengers may be left off. In another method, the least crowded car is allocated to the hall call made on the important floor on which there are executive rooms or rooms for distinguished guests. Japanese Utility-Model Laid-Open No. 135969/1981 describes a method in which the estimated value of the number of passengers who get on or can get on the car is informed to the passengers who wait for the car using an annunciator provided at the elevator hall. In these group control apparatus also, accuracy of the estimated car crowdedness greatly affects the performance of group-control.

Conventionally, the following two types of methods of estimating the car crowdedness have been proposed.

(A) The estimated number of passengers in the car is obtained for each hall by distributing the number of passengers in the car to the destination floors to which the car call is made, by adding the number of passengers who wait for the car at the hall, detected by the waiting passenger detector, to the number of passengers in the car and by subtracting the number of passengers for each of the destination floors to which the car call is made (see Japanese Patent Laid-Open No. 102044/1975, Japanese Patent Publication No. 35368/1979 and so on)

(B) With variations in the estimated value of the car load (proportion to the rated load) taken into consideration, the probability (the full packing passage probability) with which the fully packed car passes the hall and the probability (leaving off probability) with which passengers may be left behind are obtained for each hall from the estimated values of the numbers of passengers who get on and off the car before the car responds to the hall call and the number of passengers who can get on the car (disclosed in Japanese Patent Publication No. 47787/1987).

To improve the accuracy with which the estimated number of passengers in the car is estimated, the following methods (C) and (D) have been proposed.

(C) The number of passengers in the car is distributed by a predetermined rate to the floors to which the car call is made, and the number of passengers for each destination floor is detected. At that time, correction is made such that the sum of the numbers of passengers in the car which are distributed to the individual destination floors equals the number of passengers in the car (Japanese Patent Publication No. 24578/1979).

(D) Each time the number of passengers in the car or the status of the car call changes, the estimated number of passengers in the car for each destination floor is corrected, by which accurate estimation is made on the basis of the latest traffic (Japanese Patent Publication No. 35371/1979).

In the above-described method (A), provision of the waiting passenger detector is the requirement. However, the waiting passenger detector is expensive and may not be provided on each floor. Accordingly, the following method (E) has been proposed.

(E) the number of passengers who wait for the car at the hall is estimated using a constant value determined in accordance with the past traffic demands, and the estimated number of passengers in the car is operated on the basis of the number of waiting passengers (Japanese Patent Publication No. 35372/1979).

However, since the accuracy with which the number of passengers who wait for the car at the hall is estimated is low in the above method (E), the accuracy with which the estimated number of passengers in the car is estimated does not improve. Hence, the following methods (F) to (H) have been proposed so as to achieve accurate estimation of the number of passengers in the car even when no waiting passenger detector is provided.

(F) The number of passengers who wait for the car is estimated on the basis of the duration of the hall call, and the estimated number of passengers in the car is operated using the obtained number of waiting passengers.

(G) The average traffic per unit time is estimated by measuring the traffic on the service floors, and the number of passengers who wait for the car is estimated using the average traffic and the estimated time required for the car to arrive. The estimated number of passengers in the car is determined using the obtained estimated number of waiting passengers (Japanese Patent Laid-Open Nos. 4583/1984, 182182/1984)

(H) The estimated number of passengers in the car is determined using the number of passengers who wait for the car at the hall which is input by the passengers themselves from the hall waiting passenger input device (Japanese Patent Laid-Open No. 1246710/1984).

Japanese Patent Laid-Open No. 275381/1989 discloses a group-control apparatus which selects the car to be allocated to the hall call on the basis of the operation conducted using the neural net corresponding to the neurons of the human's brain. However, no consideration is given to the improvement of the accuracy with which the estimated car crowdedness is determined.

As stated above, in the conventional elevator control apparatus, various elements, including the number of passengers in the car, the state of the car call, estimation of the numbers of passengers who get on and off the elevator at each floor the elevator stops, estimation of the number of passengers on each destination floor, the traffic on each floor, are taken into consideration in order to operate the estimated car crowdedness with a high degree of accuracy. However, estimation of these elements with ever-changing complicated traffic taken into consideration makes the operation expressions for the estimated car crowdedness more complicated. Now that there is a limitation to the human ability, complicated operation expressions make development of new operation expression which provide improved operation is difficult. Furthermore, detailed estimation increases the time required for the operation. This makes quick allocation of the car and forecasting of the estimated car crowdedness impossible.

SUMMARY OF THE INVENTION

Accordingly, an object of the present invention is to provide an elevator control apparatus which is directed to overcoming the aforementioned problems of the conventional techniques and which is capable of estimating the car crowdedness with a high degree of accuracy by conducting estimation flexibly in accordance with the traffic.

In order to achieve the above object, there is provided an elevator control apparatus which comprises:

an input data conversion means for converting traffic data, including .a position of the car, a direction of a movement, a car load and calls to be responded, into a form in which it can be used as input data of a neural net;

an estimated car crowdedness operation means including an input layer for taking in the input data, an output layer for outputting the estimated car crowdedness, and an intermediate layer provided between said input and output layers and in which a weighting factor is set, said estimated car crowdedness operation means constituting said neural net; and an output data conversion means for converting the estimated car crowdedness output from said output layer into a form in which it can be used for a predetermined control operation.

BRIEF DESCRIPTION OF THE DRAWINGS

FIGS. 8A and 8B are memory maps of a RAM in the group control device.

DESCRIPTION OF THE PREFERRED EMBODIMENTS

An embodiment of the present invention will now be described with reference to the accompanying drawings.

Figure 1:
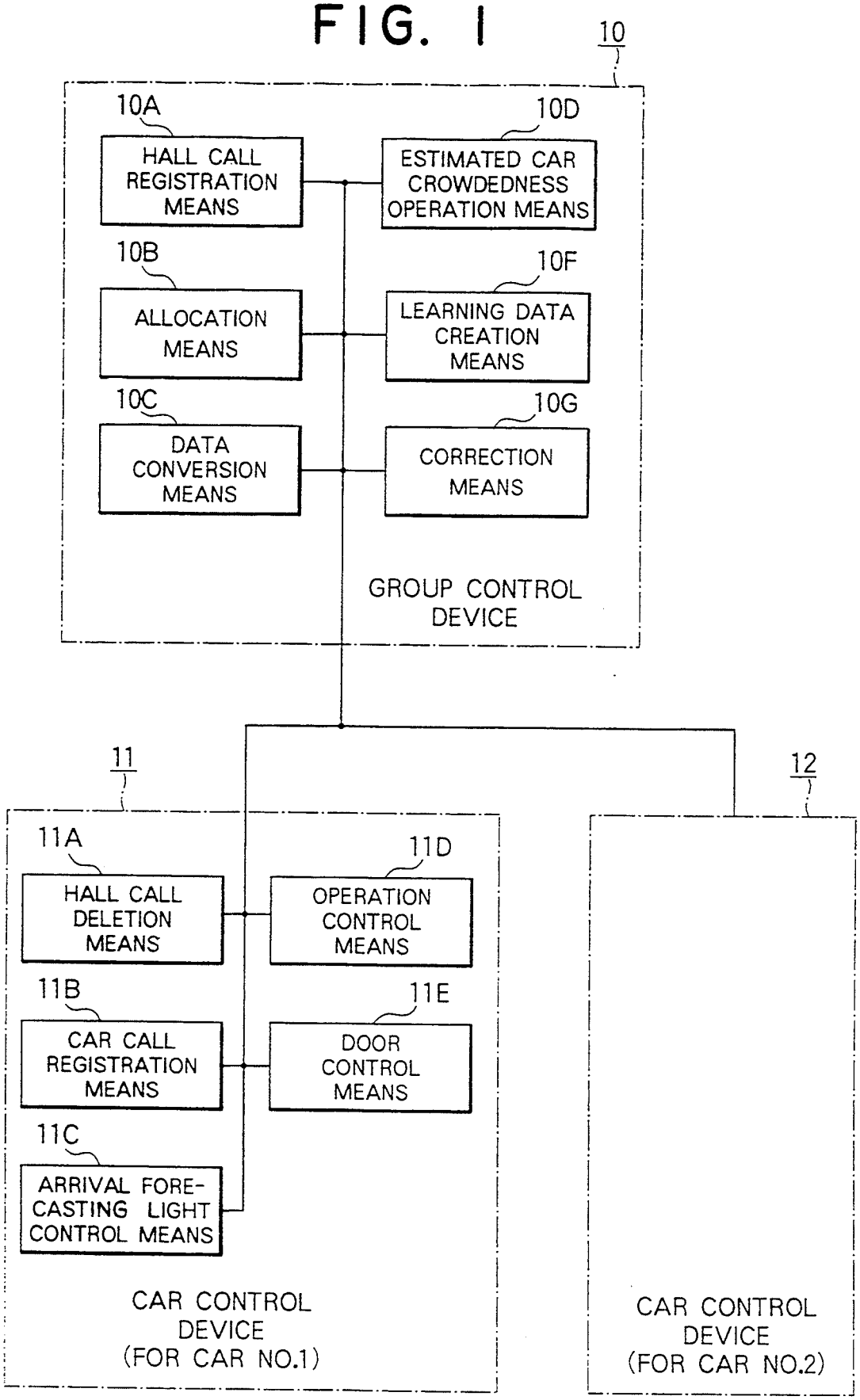
FIG. 1 is a block diagram of a first embodiment of an elevator control apparatus according to the present invention.

Referring first to FIG. 1, a group control device 10 includes a hall call registration means 10A, an allocation means 10B, a data conversion means 10C, an estimated car crowdedness operation means 10D, a learning data creation means 10F, and a correction means 10G. The group control device 10 controls a plurality of car control devices 11 and 12 (for, for example, car Nos. 1 and 2).

The hall call registration means 10A registers and cancels the hall call on each floor (the hall call for ascent or descent), and determines the time which elapses after the hall call is registered (that is, the duration of the hall call).

The allocation means 10B selectively allocates the best serviceable car for a hall call. To accomplish this, the allocation means 10B calculates an evaluated value on the basis of the estimated waiting time for the hall call and the estimated car crowdedness (estimated car load), and allocates the car which has the minimum evaluated value.

The data conversion means 10C includes an input data conversion means for converting the traffic data, including the car position, the direction of the movement, the car load, the call to be responded (car call or hall call to which allocation is made), into a form in which they can be used as input data to the neural net, and an output data conversion means for converting the output data of the neural net (which corresponds to the estimated car crowdedness) into a form in which they can be used for a predetermined control operation (for example, for operating an evaluated value).

As will be described below in detail, the estimated car crowdedness determining means 10D for operating an estimated car crowdedness for each car in accordance with the time zone contains a neural net which includes an input layer for taking in input data, an output layer for outputting data corresponding to the estimated car crowdedness, and an intermediate layer provided between the input and output layers in which weighting factors are set.

The learning data creation means 10F stores the estimated car crowdedness for each car and the input data (traffic data) when the estimated car crowdedness is obtained and the surveyed data (teacher data) regarding the car crowdedness (car load), and outputs them as learning data.

The correction means 10G learns and corrects the function of the neural net of the estimated car crowdedness operation means 10D using the learning data.

The car control devices 11 and 12 for car Nos. 1 and 2 have the same configuration. For example, the car control device 11 for car No. 1 is constructed by the following known means 11A to 11E.

The hall call deletion means 11A outputs a hall call deletion signal relative to the hall call made at each floor. The car call registration means lib registers the car call made relative to each floor. The arrival forecasting light control means 11C controls lightening up of the arrival forecasting light provided at each floor. The operation control means lid determines the direction of movement of the car and controls the travel and stoppage of the car so that the car can respond to a car call or to a hall call to which the car is allocated. The door control means lie controls opening and closing of the door of the car.

Figure 2:
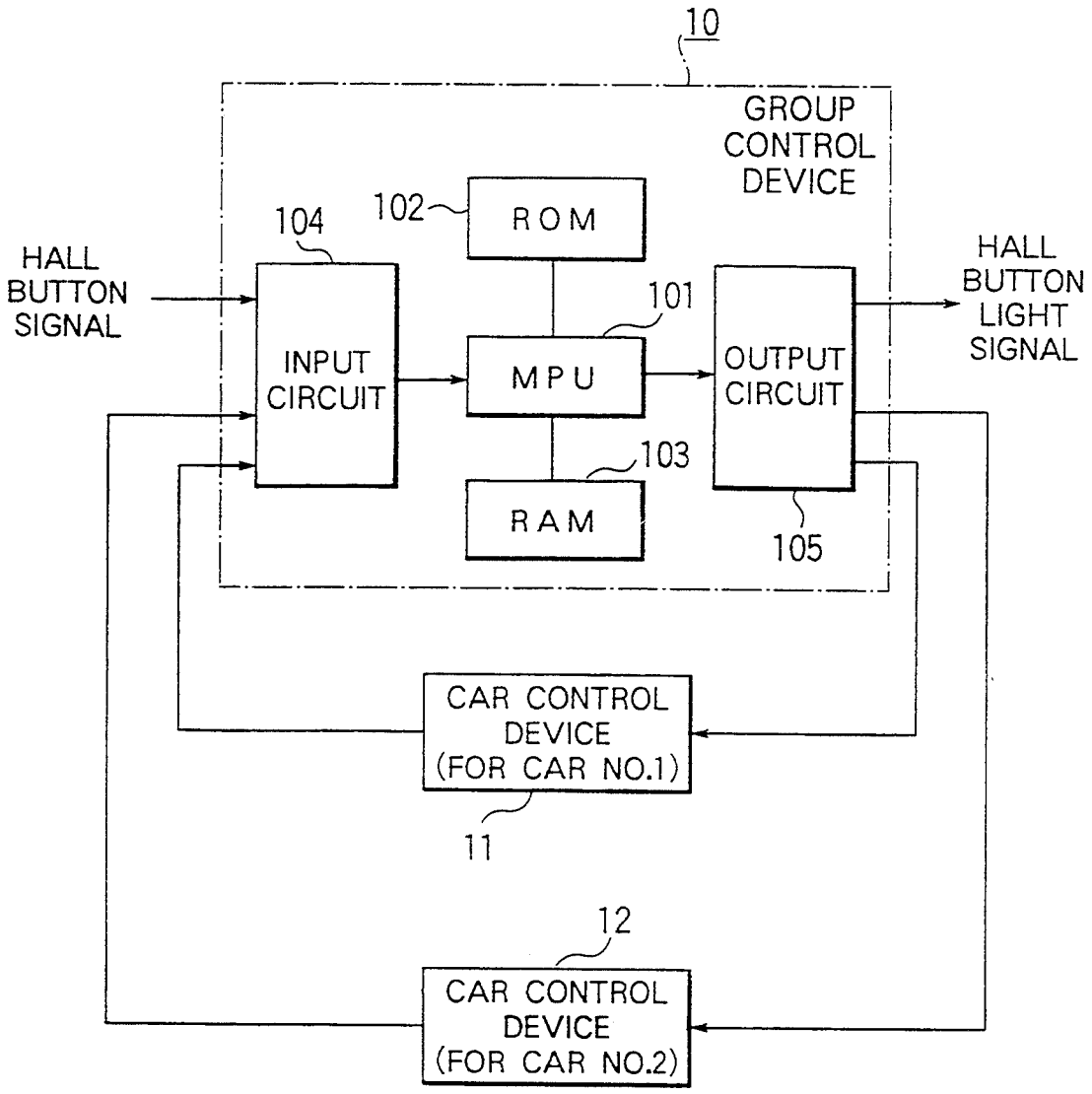
FIG. 2 is a block diagram of a group-control device of FIG. 1.

As shown in FIG. 2, the group control device 10 is a known microcomputer which is composed of a micro processing unit (MPU) or a central processing unit (CPU) 101, a ROM 102, a RAM 103, an input circuit 104, and an output circuit 105.

The input circuit 104 inputs a hall button signal 14 from a hall button provided at each floor, and status signals for car Nos. 1 and 2 from the car control devices 11 and 12. The output circuit 105 outputs a hall button light signal 15 to the hall button light incorporated in each hall button. The output circuit 105 also outputs instruction signals to the car control devices 11 and 12.

Figure 3:
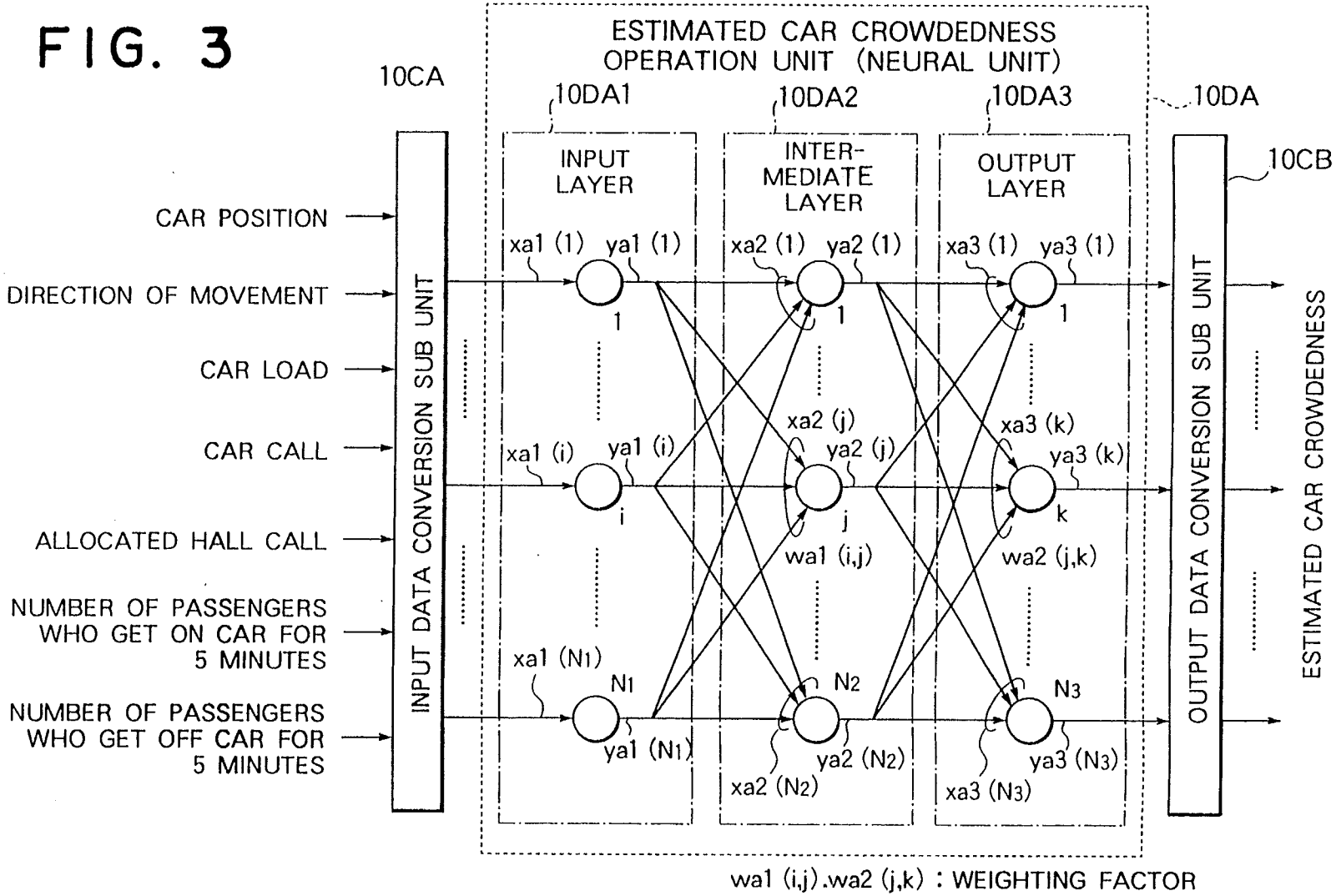
FIG. 3 is a block diagram of a data conversion means and an estimated car crowdedness operation means of FIG. 1.

FIG. 3 is a functional block diagram concretely showing the relation between the data conversion means 10C and the estimated car crowdedness operation means 10D shown in FIG. 1. The data conversion means 10C includes an input data conversion sub unit 10CA which serves as the input data conversion means and an output data conversion sub unit 10CB which functions as the output data conversion means. An estimated car crowdedness operation unit 10DA consisting of a neural net is inserted between the input data conversion sub unit 10CA and the output data conversion sub unit 10CB. The estimated car crowdedness operation unit 10DA constitutes the estimation operation sub routine used in the estimated car crowdedness operation means 10D shown in FIG. 1.

The input data conversion sub unit 10CA converts the traffic data, including the car position, the direction of movement, the car load, the call to be responded (that is, car call and the hall call to which the car is allocated), the statistic feature of the traffic (the number of people who get on the car for five minutes and the number of people who get off the car for five minutes), into the form in which they can be used as the input data to the neural net 10DA.

The output data conversion sub unit 10CB converts the output data (corresponding to the estimated car crowdedness) of the neural net 10DA into the form in which they can be used for determining the evaluated value for hall call allocation operation.

The estimated car crowdedness operation unit 10DA which consists of the neural net is made up of an input layer 10DA1 for taking in the input data from the input data conversion sub unit 10CA, an output layer 10DA3 for outputting data corresponding to the estimated car crowdedness, and an intermediate layer 10DA2 provided between the input and output layers 10DA1 and 10DA3 and in which weighting factors are set.

The layers 10DA1 to 10DA3 are connected to each other by the network, and are each constructed by a plurality of nodes.

Let N1, N2 and N3 respective be the numbers of nodes of the input layer 10DA1, intermediate layer 10DA2 and output layer 10DA3. Then, the number of nodes N3 of the output layer 10DA3 is expressed as follows:

$$N3=2(FL-1)$$

where FL is the number of floors in a building. The number of nodes N1 of the input layer 10DA1 and the number of nodes N2 of the intermediate layer 10DA2 are respectively determined in accordance with the number of floors FL of the building, the types of input data used, the number of cars and so on.

When the variables i, j and k take $i=1, 2, \ldots, N1$ $j=1, 2, \ldots, N2$ $k=1, 2, \ldots, N3$ the input and output values of the ith node of the input layer 10DA1 are expressed by xa1(i) and ya1(i) , the input and output values of the jth node of the intermediate layer 10DA2 are expressed by xa2(j) and ya2(j), and the input and output values of the kth node of the output layer 10DA3 are expressed by xa3(k) and ya3(k).

When the weighting factor between the ith node of the input layer 10DA1 and the jth node of the intermediate layer 10DA2 is wa1(i, j) and the weighting factor between the jth node of the intermediate layer 10DA2 and the kth node of the output layer 10DA3 is wa2(j, k), the relations between the input and output values of the individual nodes are expressed as follows:

$$ya1(i) = 1/[1 + \exp\{-xa1(i)\}] \quad (1)$$

$$xa2(j) = \sum_{i=1}^{N1} \{wa1(i,j) \times ya1(i)\} \quad (2)$$

$$ya2(j) = 1/[1 + \exp\{-xa2(i)\}] \quad (3)$$

$$xa3(k) = \sum_{j=1}^{N2} \{wa2(j,k) \times ya2(j)\} \quad (4)$$

$$ya3(k) = 1/[1 + \exp\{-xa3(k)\}] \quad (5)$$

where $0 \leqq$ wa1(i, j) $\leqq 1$ and $0 \leqq$ wa2(j,k) $\leqq 1$.

The group control operation conducted in this embodiment will be described below with reference to the flowchart shown in FIG. 4.

First, the group control device 10 takes in the hall button signal 14 and the status signals from the car control devices 11 and 12 in accordance with a known input program in step 31. The status signal input to the group control device 10 contains the car position, direction of the travel, stoppage or travel, the door opened/closed state, the car load, the car call, and the hall call deletion signal.

Next, in step 32, the hall call is registered or cancelled, the hall button light is lit up or put out, and the duration of the hall call is determined in accordance with a known hall call registration program.

Next, in step 33, it is determined whether or not a new hall call C is registered. If the answer is yes, an estimated car crowdedness Ta1(k) of car No. 1 relative to each hall k (=1, 2, . . . , N3) when the new hall call C is virtually allocated to car No. 1 is determined in step 34 in accordance with the program of estimating the car crowdedness when car No. 1 is virtually allocated.

Similarly, in step 35, an estimated car crowdedness Ta2(k) of car No. 2 relative to each hall k (=1, 2, . . . , N3) when the new hall call C is virtually allocated to car No. 2 is operated in accordance with the program of estimating the car crowdedness when car No. 2 is virtually allocated.

In subsequent steps 36 and 37, the program of estimating the car crowdedness when the new hall call C is ignored and is not allocated to either car No. 1 or No. 2 (at the time of non-allocation) is executed to operate the estimated car crowdedness Tb1(k) and Tb2(k) of car Nos. 1 and 2 relative to each hall.

Next, in step 38, evaluated values W1 and W2 are determined on the basis of the estimated car crowdedness Ta1(k), Ta2(k), Tb1(k) and Tb2(k) determined in steps 34 to 37, and a car which has the minimum evaluated values is selected as a car to be allocated. An allocation instruction corresponding to the hall call C and a forecasting instruction are assigned to the car to be allocated. The evaluated values W1 and W2 may be determined using the method described in, for example, Japanese Patent Laid-Open No. 177266/1984.

Next, in step 39, the hall button light signal 15 set in the manner described above is sent out to the corresponding hall and the allocation signal and the forecasting signal are sent out to the car control device 11 or 12 using an output program.

Next, in step 40, the converted traffic data, the estimated car crowdedness for each hall and the surveyed data on the car crowdedness (car load) for each car are stored and output as learning data in accordance with a learning data creation program.

In step 41, the weighting factors for the network in the estimated car crowdedness operation means 10D are corrected in accordance with the learning data and a correction program.

The group control device 10 performs group control over the plurality of elevator cars by executing the processings from step 31 to step 41 repetitively.

If it is determined in step 33 that the new hall call C is not registered, the process goes from step 33 to step 39.

Figure 5:
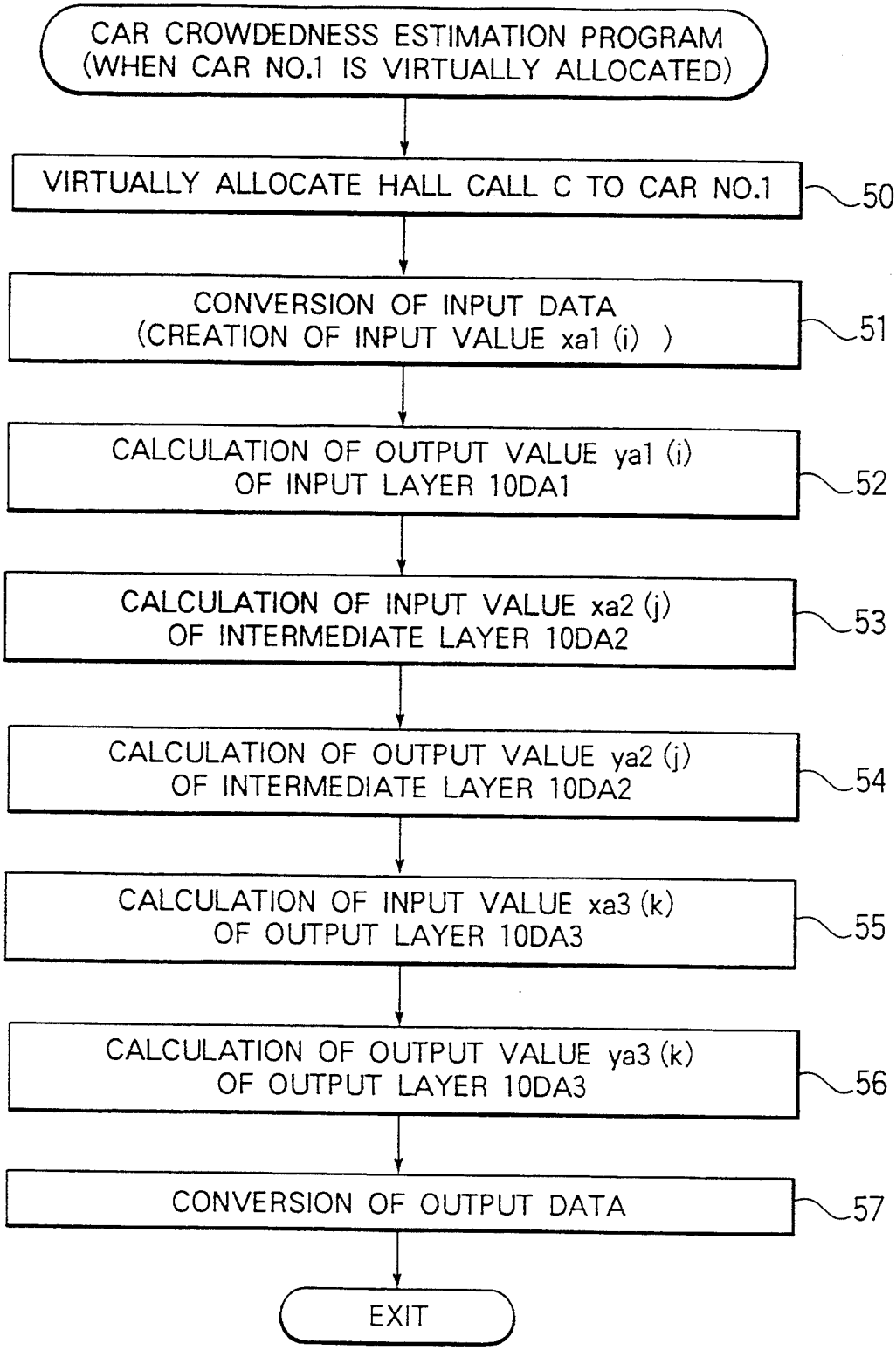
FIG. 5 is a flowchart showing an estimated car crowdedness operation program used in the program of FIG. 4 when the car is virtually allocated.

Next, the operation of the car crowdedness estimation program executed in the process of step 34 will be described concretely with reference to FIG. 5 as an example of the processes from step 34 to step 37.

First, in step 50, the new hall call C is virtually allocated to car No. 1, and allocated hall call data to be input to the input data conversion sub unit 10CA is created.

In step 35, the new hall call C is virtually allocated to car No. 2, and an allocated hall call data is created. In the processes of steps 36 and 37, allocated hall call data when no allocation is made is used as the allocated hall call data.

Next, in step 51, the data from the car on which the estimated car crowdedness is to be determined (including the car position, direction of the movement, the car load, the car call and the allocated hall call) and the data representing the statistical feature of the traffic at the present time are taken out from among the traffic data which is input, and the data is converted into data xa1(1) to xa1(N1) that can be input to the individual nodes of the input layer 10DA1 of the estimated car crowdedness operation unit 10DA.

If the number of floors FL of the building is twelve and if the hall No. f=1, 2, . . . , 11 respectively represent the ascending halls on the first, second, . . . , eleventh floors while the hall No. f=12, 13, . . . , 22 respectively represent the descending halls on the twelfth, eleventh, . . . second floors, the state of a car "in which the car positioned floor is f and in which the direction of movement is upward" is expressed as follows:

$$xa1(f)=1$$

$$xa1(i)=0$$

$$(i=1, 2, \ldots 22, i \neq f)$$

The state of the car is expressed using a value normalized within a range from 0 to 1. The car load xa1 (23) is normalized to a value ranging from 0 to 1 by dividing it by the maximum value NTmax (for example, 120%) that the car load xa1(23) can take.

"1" is assigned to the car calls, xa1(24) to xa1(35), made relative to the first to twelfth floors when they are registered, and "0" is assigned to the car calls when they are not registered. "1" is assigned to the ascending hall calls, xa1(36) to xa1(46), made on the first to eleventh floors when they are allocated, and "0" is assigned to the ascending hall calls when they are not allocated. "1" is assigned to the descending hall calls, xa1(47) to xa1(57), made on the twelfth to second floors when they are allocated, and "0" is assigned to them when they are not allocated.

The numbers of passengers, xa1(58) to xa1(68), who get on the ascending car for five minutes on the first to eleventh floors are normalized to a value ranging from 0 to 1 by dividing the numbers of passengers per five minutes obtained from the statistics of the past traffic by the maximum value NNmax (for example, one hundred passengers) that the numbers of passengers can take. The numbers of passengers, xa1(69) to xa1(79), who get on the descending car for five minutes on the twelfth to second floors, the numbers of passengers, xa1(80) to xa1(90), who get off the ascending car for five minutes on the first to eleventh floors, and the numbers of passengers, xa1(91) to xa1(101), who get off the descending car for five minutes on the twelfth to second floors are respectively normalized by dividing the statistic numbers by the maximum value NNmax.

The method of normalizing the input data is not limited to the above-described method but the car position and the direction of the movement may be expressed separately. For example, the input value xa1(1) of the first node which represents the car positioned floor when the car positioned floor is f may be expressed by $$xa1(1)=f/FL$$

"+1" may be assigned to the input value xa1(2) of the second node which represents the direction of the movement of the car when the car is ascending, "−1" may be assigned to the input value xa1(2) when the car is descending, and "0" may be assigned to the input value xa1(2) when the car is moving in no direction.

Once the input data to be input to the input layer 10DA1 is set in step 51, the network operation is performed in steps 52 to 56 to estimate the car crowdedness obtained when the new hall call C is virtually allocated to car No.

First, in step 52, the output value ya1(i) of the input layer 10DA1 is determined using Equation (1) which employs the input data xa1(i).

Subsequently, in step 53, the input value xa2(j) of the intermediate layer 10DA2 is determined using Equation (2) by multiplying the output value ya1(i) obtained by Equation (1) by the weighting factor wa1(i, j) and by totalling the resultant values regarding i=1 to N1.

Next, in step 54, the output value ya2(j) of the intermediate layer 10DA2 is determined using Equation (3) which employs the input data xa2(j) obtained by Equation (2).

Subsequently, in step 55, the input value xa3(k) of the output layer 10DA3 is determined using Equation (4) by multiplying the output value ya2(j) obtained from Equation (3) by the weighting factor wa2(j,k) and by totalling the resultant values regarding j=1 to N2.

Thereafter, in step 56, the output value ya3(k) of the output layer 10DA3 is determined using Equation (5) which employs the input value xa3(k) obtained by Equation (4).

Once the network operation on the estimated car crowdedness is completed, the output data conversion sub unit 10CB shown in FIG. 1 converts the output values ya3(1) to ya3(N3) in step 57 to determine the final estimated car crowdedness.

At that time, the individual nodes of the output layer 10DA3 correspond to the halls for opposite directions: the output values ya3(1) to ya3(11) of the first to eleventh nodes are respectively used to determine the operated values of the estimated car crowdedness for the ascending halls on the first, second, . . . , eleventh floors, and the output values ya3(12) to ya3(22) are respectively used to determine the operated values of the estimated car crowdedness for the descending halls.

That is, the output value ya3(k) of the kth node is converted into the estimated car crowdedness T(k) of the hall k which is expressed as follows:

$$T(k)=ya3(k)\times NTmax \quad (6)$$

where NTmax is the constant value which represents the maximum value of the estimated car crowdedness. Since the output value ya3(k) of the kth node is normalized to a value ranging from 0 to 1, it is converted to a value which can be used for operating the evaluated value of the hall call allocation by multiplying it by the maximum value NTmax by Equation (6) .

In the car crowdedness estimation program, the relation of cause and effect between the traffic and the estimated car crowdedness is expressed in the form of a network, and the traffic data is taken into the neural net to determined an estimated car crowdedness. In consequence, an estimated car crowdedness which is very close to an actual car crowdedness can be obtained with a high degree of accuracy that realized by the conventional methods. Furthermore, since the car to be allocated to the hall call is selected on the basis of the estimated car crowdedness, the waiting time for the hall call can be shortened, and occurrence of car full or passenger left-off conditions can be reduced.

However, since the network changes as a consequence of changes in the weighting factors wa1(i, j) and wa2(j, k) which connect the individual nodes in the neural net 10DA, the estimated car crowdedness can be determined further adequately by appropriately changing and correcting the weighting factors wa1(i, j) and wa2(j, k) through learning.

Next, the operations performed in the learning data creation and correction programs (steps 40 and 41) executed by the learning data creation and correction means 10F and 10G will be described with reference to FIGS. 6 and 7.

Learning (correction of the network) is effectively performed using the back propagation method. Back propagation is a method of correcting the weighting factors which connect the network using an error between the output data of the network and a desired output data (teacher data) created from surveyed data or a control objective value.

Figure 6:
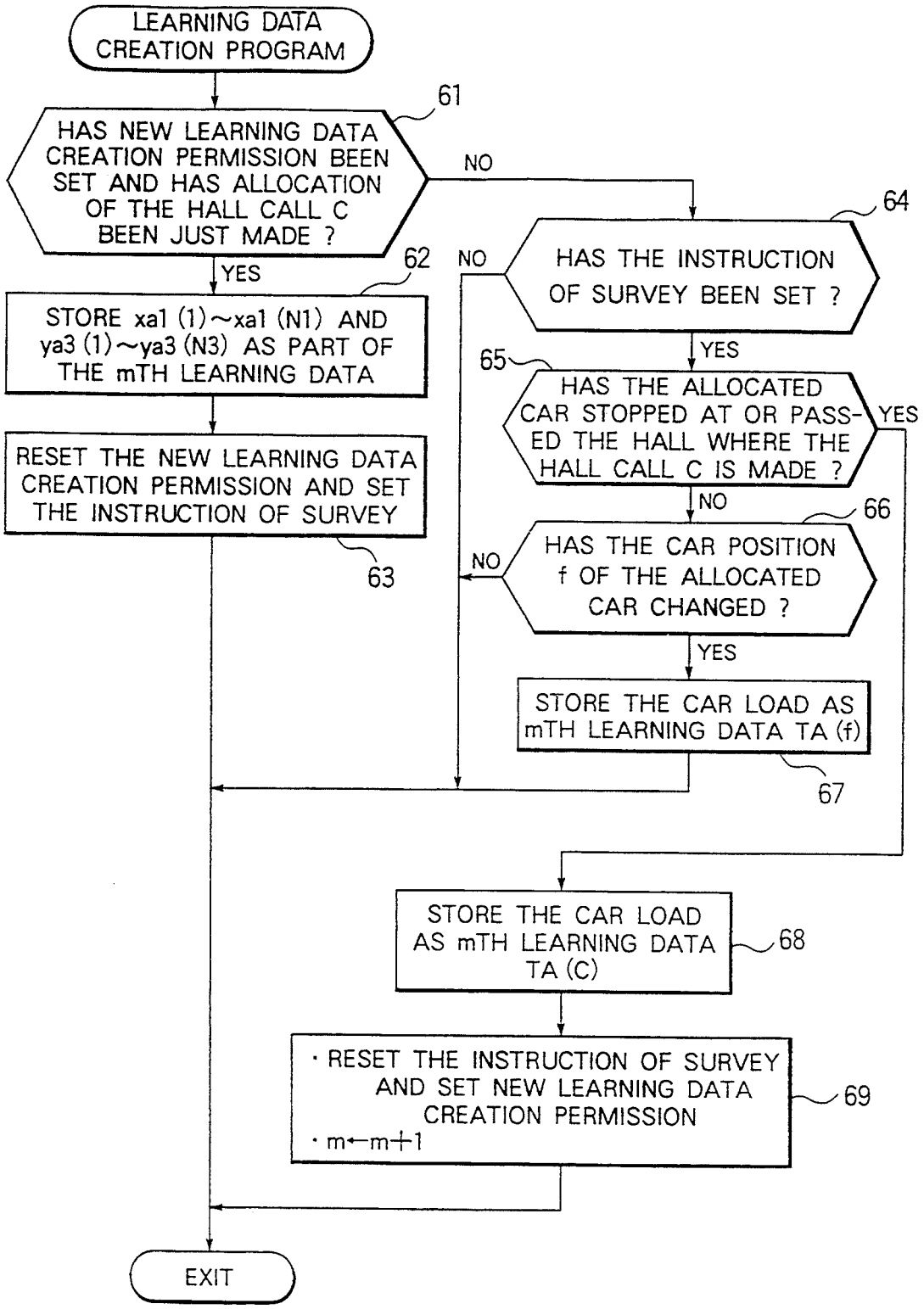
FIG. 6 is a flowchart showing a learning data creation program used in the program of FIG. 4.

In the flowchart of the learning data creation program shown in FIG. 6, it is determined in step 61 whether or not the new learning data creation permission has been set and whether or not allocation of the new hall call C has just been made.

If the learning data creation permission has been set and if allocation of the hall call C has been made, the traffic data xa1(1) to xa1(N1) on the allocated car when allocation is made and the output data ya3(1) to ya3(N3) corresponding to the estimated car crowdedness on the individual halls are stored as part of the mth learning data (teacher data) in step 62.

Subsequently, in step 63, new learning data creation permission is reset, and the instruction of surveying the car crowdedness (car load) is set and counting of the actual car load is thereby started.

Hence, it is determined in step 61 in the subsequent operation period that the new learning data creation permission is not set, and the process goes to step 64 in which it is determined whether or not the instruction of surveying the first car crowdedness is set. Since the survey instruction has already been set in step 63, the process goes to step 65 and it is determined whether or not the allocated car is responded to the hall call C.

If the allocated car has not stopped at or has not passed the hall where the hall call C is made, it is determined in step 66 whether or not the car position f of the allocated car has changed.

If the change in the car position f is detected in a subsequent operation period, the actual car load obtained when the car position f has changed is stored as part of the mth learning data in step 67. This is the original teacher data and is expressed by the actual crowdedness TA(f) at the hall represented by the car position f.

If it is determined in step 65 that the allocated car has stopped at (or passed) the hall where the hall call C is made in a subsequent operation period, the process proceeds to step 68 and the actual car load obtained when the detection is made is stored as part of the ruth learning data, i.e., as the actual crowdedness TA(C).

Thereafter, the instruction of surveying the car load is reset and counting of the actual car load is thereby completed, and the learning data No. m is incremented and the new learning data creation permission is set in step 69.

In this way, the input and output data on the allocated car, as well as the actual crowdednesses on the individual halls the allocated car stops or passes by the time it responds to the hall call C, are created and stored as the learning data synchronously with the allocation of the allocated car to the hall call.

Figure 4:
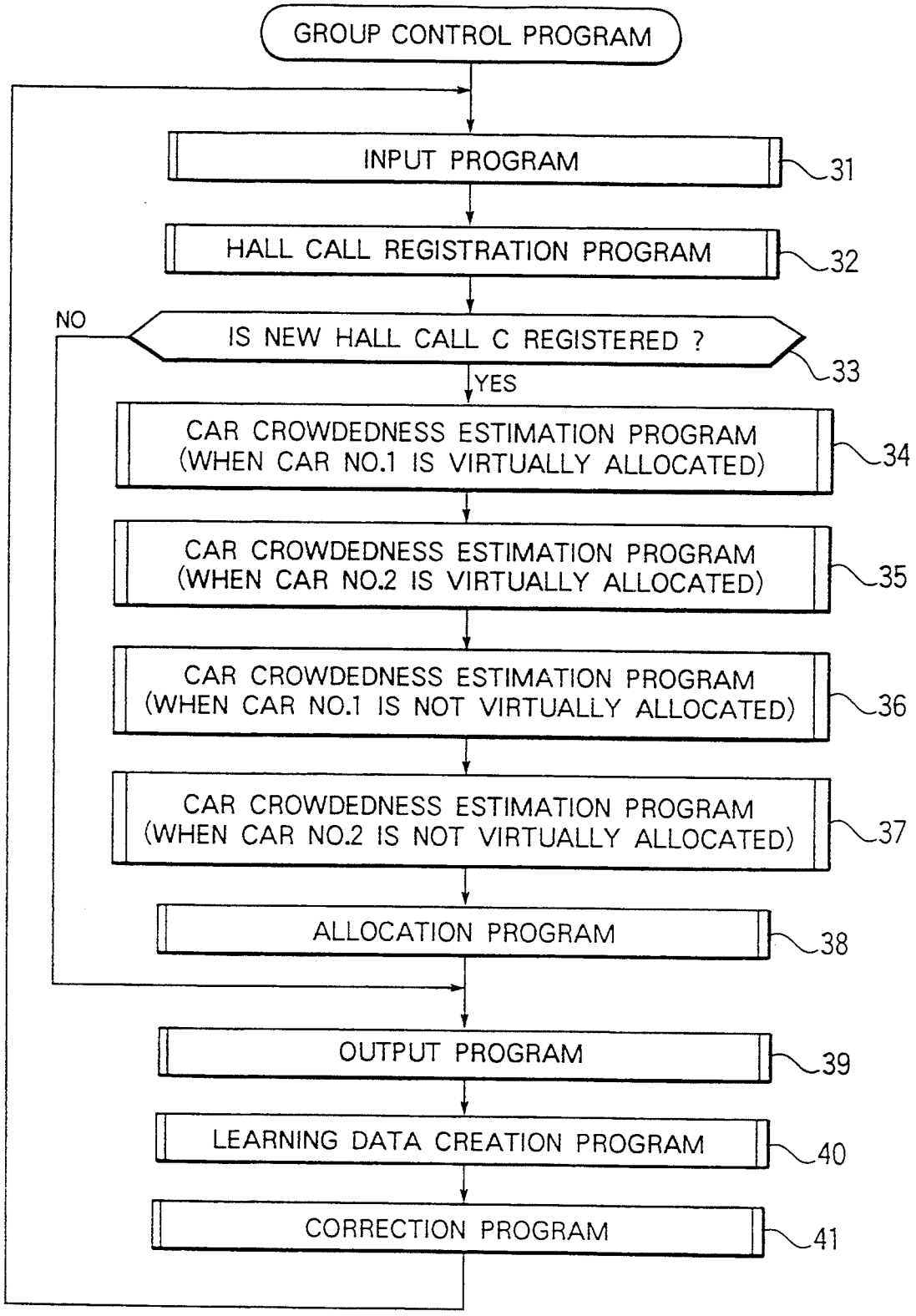
FIG. 4 is a flowchart showing a group control program used in the first embodiment.

Next, the correction means 10G corrects the neural net 10DA using the learning data in accordance with the correction program (in step 41) shown in FIG. 4.

The correction operation performed by the correction means will now be described in detail with reference to FIG. 7.

First in step 71, it is determined whether or not it is the time correction of the network is to be made. If the answer is yes, the processes from steps 72 to 78 are executed.

In this embodiment, correction of the network is made when the number m of learning data sets has reached S (for example, 500). The reference number S for the learning data may be set freely in accordance with the size of the network, e.g., in accordance with the number of elevators installed, the number of floors FL of the building, and the number of hall calls.

If it is determined in step 71 that the number m of learning data sets has reached S, the counting No. n of the learning data is initialized to '1' in step 72. Thereafter, in step 73, the actual crowdedness TA(k) is taken out from among the nth learning data, and the value of the node corresponding to the hall of the actual crowdedness, i.e., the teaching data da(k) (k=1, 2, . . . , N3), is obtained by the following equation:

$$da(k)=TA(K)/NTmax \tag{7}$$

Next, the error Ea between the output value ya3(1) to ya3(N3) of the output layer 10DA3 taken out from among the nth learning data and the teacher data da(1) to da(N3) is obtained by the following equation:

$$Ea = \sum_{k=1}^{N3} [\{da(k) - ya3(k)\}^2]/2 \tag{8}$$

In step 74, the weighting factor wa2 (j, k) (j=1, 2, . . . , N2, k=1, 2, . . . N3) between the intermediate layer 10DA2 and the output layer 10DA3 is corrected using the error Ea obtained by Equation (8) as follows:

First, variation Δwa2(j, k) in the weighting factor is obtained as follows by differentiating the error Ea obtained by Equation (8) by wa2(j, k) and by re-arranging the resultant value using Equations (1) to (5):

$$\begin{aligned} \Delta wa2(j,k) &= -\alpha\{\partial Ea/\partial wa2(j,k)\} \\ &= -\alpha \cdot \delta a2(k) \cdot ya2(j) \end{aligned} \tag{9}$$

where α is a parameter which represents the learning rate. A given value ranging from 0 to 1 is assigned to α. In equation (9), $$\delta a2(k(=)\{ya3(k)-da(k)\}ya3(k)\ \{1-ya3(k)\}$$

Once the variation Δwa2(j, k) of the weighting factor wa2(j, k) has been calculated, the weighting factor wa2(j, k) is corrected as follows:

$$wa2(j,\ k) \leftarrow wa2(j,\ k)+\Delta wa2(j,\ k) \tag{10}$$

Thereafter, the weighting factor wa1(i, j)(i =1, 2, . . . , N1, j=1, 2, . . . , N2) between the input layer 10DA1 and the intermediate layer 10DA2 is corrected similarly in step 75 in accordance with the following Equations (11) and (12).

First, variation Δwa1(i, j) of the weighting factor wa1(i, j) is obtained by the following equation:

$$\Delta wa1(i,\ j)=-\alpha\cdot\delta a1(j)\cdot ya1(i) \tag{11}$$

where δa1(j) is expressed as follows:

$$\delta a1(j) = \sum_{k=1}^{N3} \{\delta a2(k) \cdot wa2(j,k) \cdot ya2(j) \times [1 - ya2(j)\}$$

The weighting factor wa1(i, j) is corrected using the variation Δwa1(i, j) obtained by Equation (11) as follows:

$$wa1(i,\ j) \leftarrow wa1(i,\ j)+\Delta wa1(i,\ j) \tag{12}$$

In steps 74 and 75, only the weighting factors associated with the halls whose teacher data is present are corrected. That is, as stated above in connection with the learning data creation program shown in FIG. 6, the actual car loads for only the halls located between the car position when the allocation is made and the hall where the hall call C is made are stored as the teacher data.

Once correction has been made using the nth learning data in steps 73 to 75, the learning data No. n is incremented in step 76, and the processes from step 73 to 76 are then repeated until it is determined in step 77 that correction has been made on all the learning data (until n ≧ m).

Once correction on all the learning data has been completed, the corrected weighting factors wa1(i, j) and wa2 (j, k) are registered in the estimated car crowdedness operation means 10D in step 78.

At that time, all the learning data used for correction is cleared so that new learning data can be stored, and the learning data No m is then initialized to "1", thereby completing the network correction (learning) for the neural net 10DA.

Figure 8A:
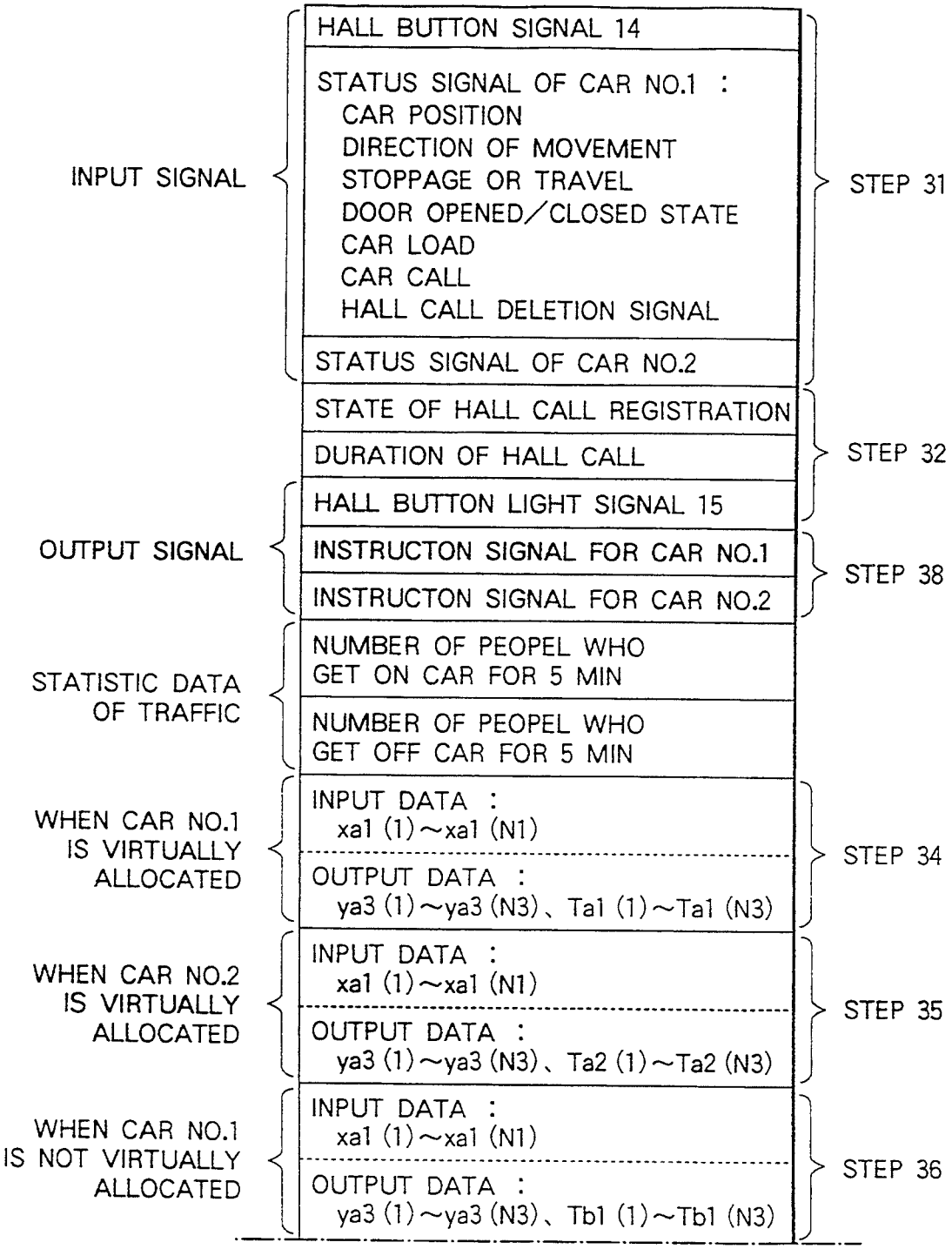

Data handled in the above-described steps are stored in the RAM 103 of the group control device 10 as shown in FIGS. 8A and 8B.

Thus, the learning data is created on the basis of the surveyed values, and the weighting factors wa1(i, j) and wa2(j, k) for the estimated car crowdedness operation means 10D are respectively corrected using the learning data. It is therefore possible to automatically cope with changes in the traffic in the building.

Furthermore, since the statistically obtained numbers of passengers who get on and get off the elevator on each hall for five minutes are also used as input data representing a feature of the traffic, more flexible and accurate estimation can be made as compared with the case in which the car position, the direction of the movement, the car load and the call to be responded alone are used as the input data which represents an ever-changing traffic.

In the above embodiment, the estimated value of the car load (the proportion of the value representing the weight of the passengers to the rated capacity) is used as the estimated car crowdedness. However, any type of index which represents the possibility of the packing to full capacity, such as the estimated value of the weight of the passengers or of the number of passengers who may get on the car, or the probability of the packing to full capacity, may also be used.

In a case where, for example, the probability of the packing to full capacity is used as the estimated car crowdedness, as in the case of the elevator group control apparatus disclosed in Japanese Patent Publication No. 47787/1987, the output values ya3(1) to ya3(11) of the first to eleventh nodes in the output values ya3(1) to ya3(N3) of the output layer 10DA3 of the neural net 10DA are respectively made to correspond to the probabilities of the full capacity packing of the ascending halls on the first to eleventh floors, and the output values ya3(12) to ya3(22) of the twelfth to twenty-second nodes are respectively made to correspond to the probabilities of the full capacity packing of the descending halls on the twelfth to second floors. At that time, since the output value ya3(k) (k=1, 2, . . . , N3) of the kth node has been normalized to a value ranging from 0 to 1, it is used as it is for operating the evaluated value for the allocation of the hall call. Hence, the estimated car crowdedness T(k) at the hall k is expressed as follows:

$$T(k)=ya3(k) \tag{13}$$

Figure 9:
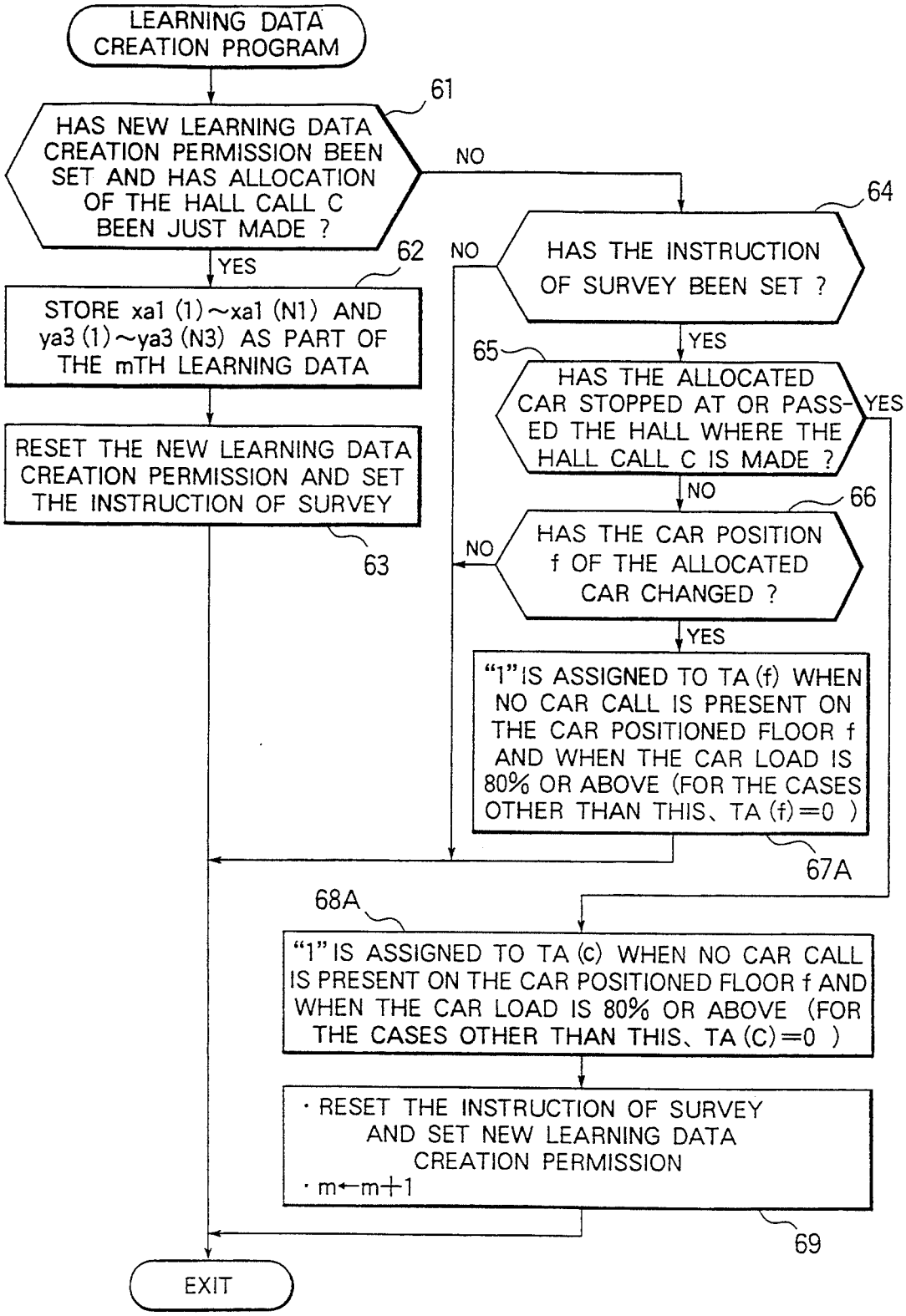
FIG. 9 is a flowchart showing the learning data creation program used in a second embodiment of the present invention.

FIG. 9 is a flowchart of the operation of the learning data creation program (step 40) when the probability of the full capacity packing is used as the estimated car crowdedness. In FIG. 9, steps 61 to 66 correspond to steps 61 to 66 in the program shown in FIG. 6.

If it is determined in step 66 that the car position f of the allocated car has changed, "1" is assigned to the mth learning data TA(f) in step 67A assuming that full-packing passage occurs when no car call is made relative to the car positioned floor f and when the load thereof is 80% or above, and the learning data TA(f) is stored. For the cases other than the above-described one, "0" is assigned to the learning data TA(f) .

If it is determined in step 65 that the allocated car has stopped at or passed the hall where the hall call C is made, "1" is assigned to the ruth learning data TA(C) in step 68A assuming that full-packing passage occurs when no car call is made relative to the car positioned floor f and when the load is 80% or above, and the learning data TA(C) is stored. For the cases other than the above-described one, "0" is assigned to the learning data TA(C).

Full-packing passage is in general the operation of causing the car to automatically pass the hall to which no car call is made and where the hall call is made. Hence, in steps 67A and 68A in FIG. 9, "1" is assigned to the learning data when the car load is 80% or above when the car reaches the hall to which no car call is made (whether the allocated hall call is made to that hall or not). "0" is assigned to the learning data in the cases other than the above-described one. At that time, the learning data is converted into the teacher data da(k) as follows:

$$da(k)=TA(k) \tag{14}$$

Figure 7:
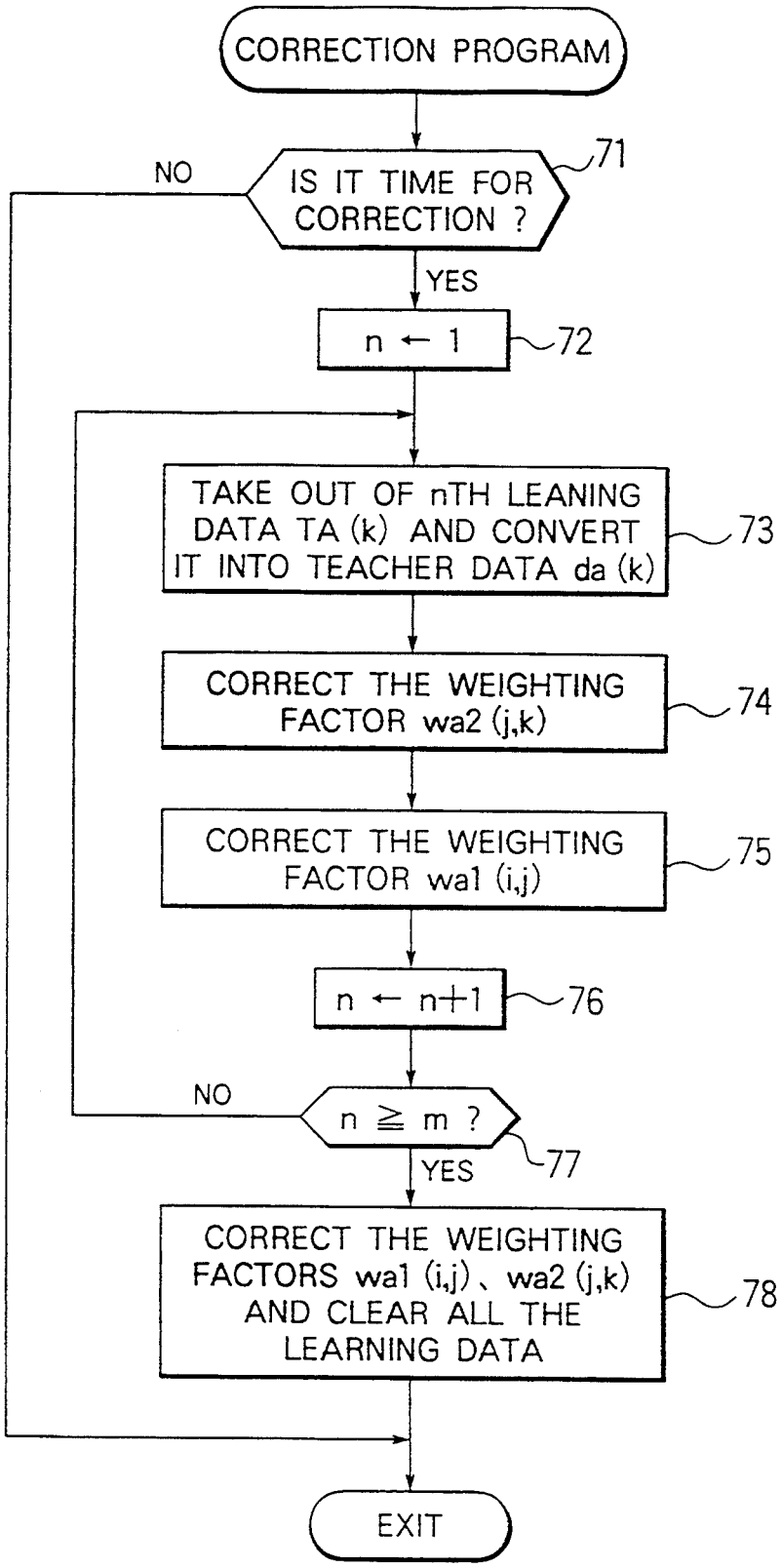
FIG. 7 is a flowchart showing a correction program used in the program of FIG. 4.

The correction program (step 41) shown in FIG. 7 is executed on the basis of the thus-created learning data to correct the weighting factors.

In the above-described embodiments, the input data conversion means performs conversion on the car position, the direction of the movement, the car load, and the calls to be responded. However, the traffic data used as the input data is not limited to the above-described ones. For example, the status of the car (the speed is being decreased, the door opening operation is being made, the door is being opened, the door closing operation is being made, the car is waiting with its door closed, and the car is moving), the duration of the hall call, the duration of the car call and the number of cars on which group control is performed may also be used as the input data. Furthermore, not only the current traffic data but also the traffic data in the near future (the history of the car's movement or that of the car's response to the call) may also be used as the input data. In this way, more accurate operation of the estimated car crowdedness is made possible.

Furthermore, in the above-described embodiments, the learning data creation means 10F stores as the learning data set the estimated car crowdedness of the allocated car for each floor, the input data when allocation of the hall call C is made, and the actual crowdedness for each hall at which the allocated car stops or passes before it responds to the hall call when allocation of the hall call is made. However, the timing of learning data creation is not limited to the above-described one. For example, the learning data may be created a predetermined period of time (for example, one minute) after the previous input data has been stored. Alternatively, the learning data may be created cyclically (for example, at an interval of one minute). Furthermore, since the learning conditions are improved as the number of learning data obtained under various conditions increases, the learning data may be created when any of previously determined typical statuses of the car is detected, e.g., when the car is stopped at a predetermined floor or when the car is in a predetermined state (the speed is being decreased, the car is at a stop, and so on) .

Furthermore, in the above-described embodiments, the learning data creation means 10F stores as the teaching data only the actual crowdedness for each floor at which the allocated car stops or passes by the time it responds to the allocated hall call, and the correction means 10G performs correction only on the weighting factor which is associated with the stored teaching data. However, the method of extracting the teaching data is not limited to the above-described one. For example, the estimated car crowdedness for all the halls and the actual crowdednesses that can be measured during the movement of the car may be stored, and only the weighting factor associated with the hall on which the teacher data is present may be corrected. The halls whose actual crowdedness cannot be measured correspond to those which are located farther than the floor at which the direction of the movement of the car is reversed in a case where the direction of the movement of the car is reversed at a floor located in advance of the objective floor, correspond to those located farther than the floor at which the car becomes empty in a case where the car (to which no hall call is allocated) becomes empty before it reaches the objective floor, or correspond to those located at the rear of the car positioned floor (for example, those located below the present position of the car when the car is ascending) when the input data is stored.

Furthermore, the estimated car crowdedness operation means 10D corrects the weighting factor each time the number of stored learning data reaches a predetermined number. However, the timing in which the weighting factor is corrected is not limited to the above-described one. For example, the weighting factor may be corrected at a predetermined time (for example, at an interval of one hour) using the already stored learning data. Alternatively, the weighting factor may be corrected when the traffic becomes less and the frequency with which the estimated car crowdedness operation means 10D operates the estimated car crowdedness is reduced.

What is claimed is:

1. An elevator control apparatus for estimating car crowdedness and for controlling operation of the car using the estimated car crowdedness, comprising:

an input data conversion means for converting a traffic data signal, including car position data, car direction data, car load data and data regarding car calls and hall calls into a form which is usable as an input for a neural net;

an estimated car crowdedness unit including a neural net having an input layer for receiving neural net data from said input data conversion means, an output layer for outputting a signal representative of the estimated car crowdedness of a selected car, and an intermediate layer provided between the input an output layers in which weighting factors are set;

an output data conversion means for converting the signal output from the output layer into an operational control data signal;

a learning data creation means including a memory unit for storing both the estimated car crowdedness for a predetermined hall and the input data at a predetermined time, for storing, as actual car crowdedness, the car crowdedness when said car stops at or passes the predetermined hall, and for outputting the stored input data, the estimated car crowdedness and the actual car crowdedness as one learning data pair signal; and a correction means for correcting the weighting factors set in the intermediate layer of the estimated car crowdedness unit using the learning data signal said correction means being connected to said learning data creation means and to said estimated car crowdedness unit.

2. An elevator control apparatus according to claim 1 wherein the input, intermediate and output layers in said estimated car crowdedness unit each have a plurality of nodes, the intermediate layer containing weighting factors between the individual nodes of the input layer and the individual nodes of the intermediate layer and weighting factors between the individual nodes of the intermediate layer and the individual nodes of the output layer.

3. An elevator control apparatus according to claim 1 wherein said input data conversion means has a standardization means for standardizing the traffic data into a value ranging from 0 to 1.

4. An elevator control apparatus according to claim 1 wherein said estimated car crowdedness unit determines the estimated car crowdedness each time a hall call is registered.

5. An elevator control apparatus according to claim 1 wherein said learning data creation means repeatedly creates the learning data at predetermined intervals of time.

6. An elevator control apparatus according to claim 1 wherein said learning data creation means repeatedly creates the learning data each time any of previously determined typical statuses of the car is detected.

7. An elevator control apparatus according to claim 1 wherein said learning data creation means repeatedly creates the learning data each time allocation of the hall call is made.

8. An elevator control apparatus according to claim 1 wherein said estimated car crowdedness unit uses an estimated value of the car load as the estimated car crowdedness.

9. An elevator control apparatus according to claim 1 wherein said estimated car crowdedness unit uses the probability that a car is loaded to full capacity as the estimated car crowdedness.

10. An elevator control apparatus according to claim 9 wherein said learning data creation means creates the learning data assuming that the car does not stop at a given floor when no car call is made relative in the car positioned at given floor and when the car load is above a predetermined value.

11. An elevator control apparatus according to claim 2 wherein said correction means includes means for determined a desired crowdedness from the actual crowdedness and the input data, and a means for correcting the weighting factors such that and error between the desired crowdedness and the estimated car crowdedness is reduced.

12. An elevator control apparatus according to claim 2 wherein said input data conversion means converts traffic data including statistic features of the traffic and outputs the converted traffic data to said estimated car crowdedness unit.

13. An elevator control apparatus according to claim 2 wherein said input data conversion means converts the traffic data and outputs the converted traffic data to said estimated car crowdedness operation unit.

14. An elevator control apparatus according to claim 2 wherein said correction means corrects the weighting factors repeatedly at a predetermined interval of time.

15. An elevator control apparatus according to claim 2 wherein said correction means corrects the weighting factors repeatedly each time any of previously determined typical statuses of the car is detected.

16. An elevator control apparatus according to claim 2 wherein said correction means corrects the weighting factors when the frequency with which said estimated car crowdedness unit determines operates the estimated car crowdedness is reduced.

17. An elevator control apparatus according to claim 2 wherein said estimated car crowdedness unit determines an estimated car crowdedness when a new hall call is virtually allocated to the car and when a new hall call is not virtually allocated to the car.

18. An elevator control apparatus according to claim 12 wherein said input data conversion means converts the statistical number of passengers who get on the car for a given time period and the statistical number of passengers who get off the car for a given time period and outputs them to said estimated car crowdedness operation unit.

19. A method of determining an estimated degree of capacity of an elevator car comprising the steps of:

generating a user data signal including car position data, car direction data, car load data and data representing the statistical features of the traffic at the instant time, from general elevator car traffic data signal;

passing the user signal through a neural net having first, second and third layers including a plurality of nodes, and having weighting factors disposed between the nodes, the neural net generating a plurality of outputs each output corresponding to the estimated car crowdedness at a given floor;

storing data TA(f) representative of an actual car crowdedness at a hall corresponding to a car position f when a change in the car position is detected;

calculating an error between the stored data TA(f) and corresponding outputs of the neural net; and adjusting the weighting factors in the neural net according to the calculated error.

20. An elevator control apparatus for estimating car crowdedness and for controlling operation of the car using the estimated car crowdedness, comprising:

an elevator group control device which generates traffic data signals including car position data, car direction data, car load data and data regarding car calls and hall calls;

an input data conversion means for converting the traffic data signals generated by said elevator group control device into a form which is usable as an input for a neural net;

an estimated car crowdedness unit including a neural net having an input layer for receiving neural net data from said input data conversion means, an output layer for outputting a signal representative of the estimated car crowdedness of a selected car, and an intermediate layer provided between the input an output layers in which weighting factors are set;

an output data conversion means for converting the signal output from the output layer into an operational control data signal;

a learning data creation means including a memory unit for storing both the estimated car crowdedness for a predetermined hall and the input data at a predetermined time, for storing, as actual car crowdedness, the car crowdedness when said car stops at or passes the predetermined hall, and for outputting the stored input data, the estimated car crowdedness and the actual car crowdedness as a single learning data pair signal; and a correction means for correcting the weighting factors set in the intermediate layer of the estimated car crowdedness unit using the learning data signal.

* * * * *

UNITED STATES PATENT AND TRADEMARK OFFICE

CERTIFICATE OF CORRECTION

PATENT NO. : 5,331,121

DATED : July 19, 1994

INVENTOR(S) : TSUJI

It is certified that error appears in the above-indentified patent and that said Letters Patent is hereby corrected as shown below:

Column 16, lines 49-50, after "includes" insert --a--, and change "determined" to --determining--;

Column 17, line 6, delete "operates";

Column 18, line 29, change "said" to --the--;

Column 18, line 35, change "of" to --at--.

Signed and Sealed this

Fifteenth Day of November, 1994

*Attest:*

Bruce Lehman

BRUCE LEHMAN

*Attesting Officer*

*Commissioner of Patents and Trademarks*